US005330026A

United States Patent [19]

Hsu et al.

[11] Patent Number: 5,330,026

[45] Date of Patent: Jul. 19, 1994

[54] REMOTE-CONTROLLED ELECTRIC SKATE-BOARD

[76] Inventors: Chi-Hsueh Hsu, 4F, No. 144, Chu-Lin Rd., Yung-Ho Shih, Taipei Hsien; Shih-Hsin Chen, 4F, No. 35-1, Hsin-Ching, Tung-Jung Li, Sung-Shan District, Taipei, both of Taiwan

[21] Appl. No.: 68,230

[22] Filed: May 28, 1993

[51] Int. Cl.[5] ..... A63C 17/12

[52] U.S. Cl. ..... 180/181; 180/65.5; 180/65.6; 280/87.042

[58] Field of Search ..... 180/180, 181, 12, 55, 180/65.5, 65.6, 908; 280/87.041, 87.042

[56] References Cited

U.S. PATENT DOCUMENTS 4,143,728 3/1979 Shiber ..... 180/181
4,515,379 5/1989 Pasques ..... 280/87.042 X
5,020,621 6/1991 Martin ..... 280/87.042 X
5,036,941 8/1991 Denzin et al. ..... 180/65.5X
5,224,719 7/1993 Goodspeed ..... 280/87.042 X

FOREIGN PATENT DOCUMENTS 2666780 3/1992 France ..... 180/180

*Primary Examiner*—Brian L. Johnson
*Attorney, Agent, or Firm*—Morton J. Rosenberg; David I. Klein

[57] ABSTRACT

A remote controlled electric skate-board has a motor to drive two sets of sun and planet gear units connected with a pair of rollers rotated to move the skate-board by a remote controller transmitting a signal to an electronic circuit carried on the board to start or to stop the motor so that the skate-board may be moved or stopped by electric power in addition to human force.

1 Claim, 3 Drawing Sheets

REMOTE-CONTROLLED ELECTRIC SKATE-BOARD

BACKGROUND OF THE INVENTION

Skate-boards are quite popular among young boys as a recreational exercise and generally are always moved by human force.

SUMMARY OF THE INVENTION

This invention has been devised to offer a kind of skate board which can electrically be moved by a remote controller in addition to human force.

The remote-controlled electric skate-board in the present invention includes a direct current motor powered by rechargable batteries to move two rollers to move the board on which a player stands. The motor has both ends of its shaft connected with a shaft of a sun gear of two sets of sun and planet gear units to rotate the two rollers when an electronic circuit contained in a chamber of a connecting base fixed with the board receives a signal from a remote controller and starts or stops the motor.

BRIEF DESCRIPTION OF DRAWINGS

The invention will be better understood by reference to the accompanying drawings, wherein.

DESCRIPTION OF THE PREFERRED EMBODIMENTS

Figure 1:
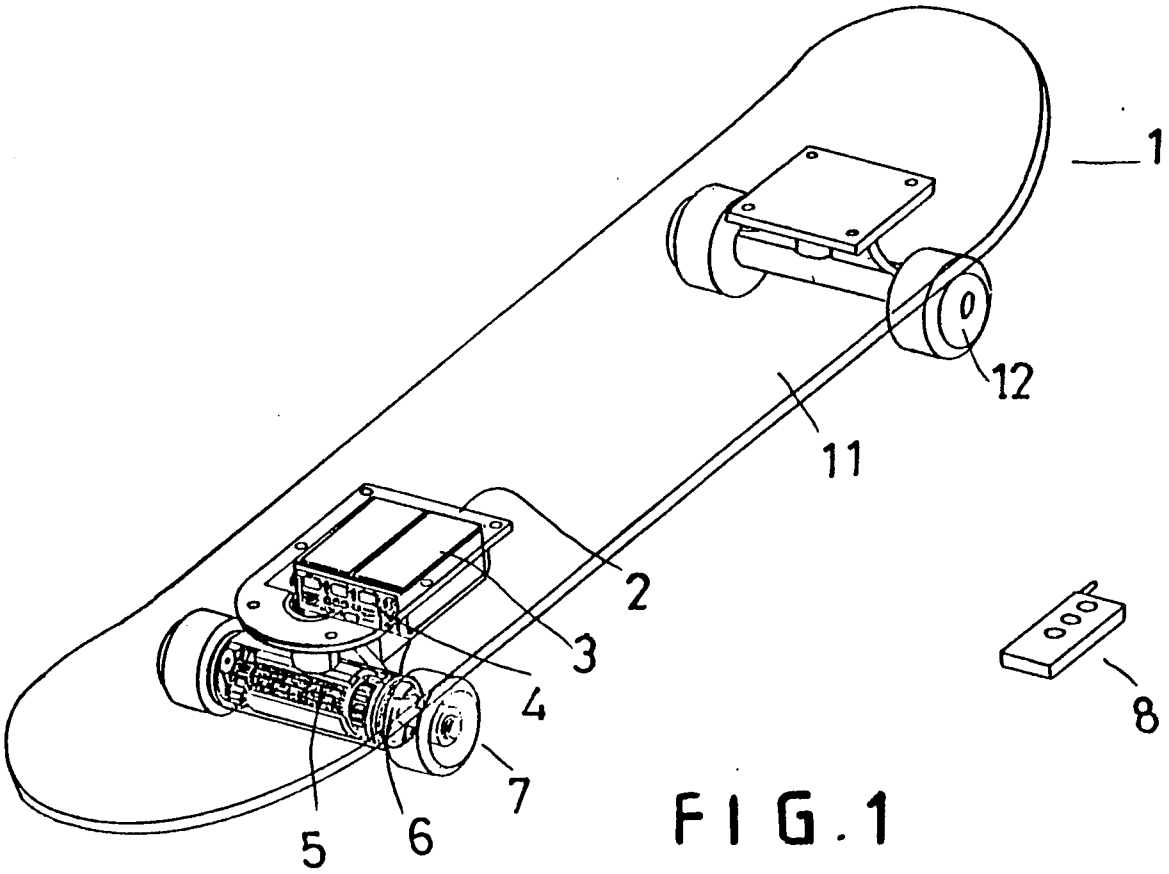
FIG. 1 is a perspective view of a remotecontrolled electric skate-board in the present invention.
Figures 2, 3:
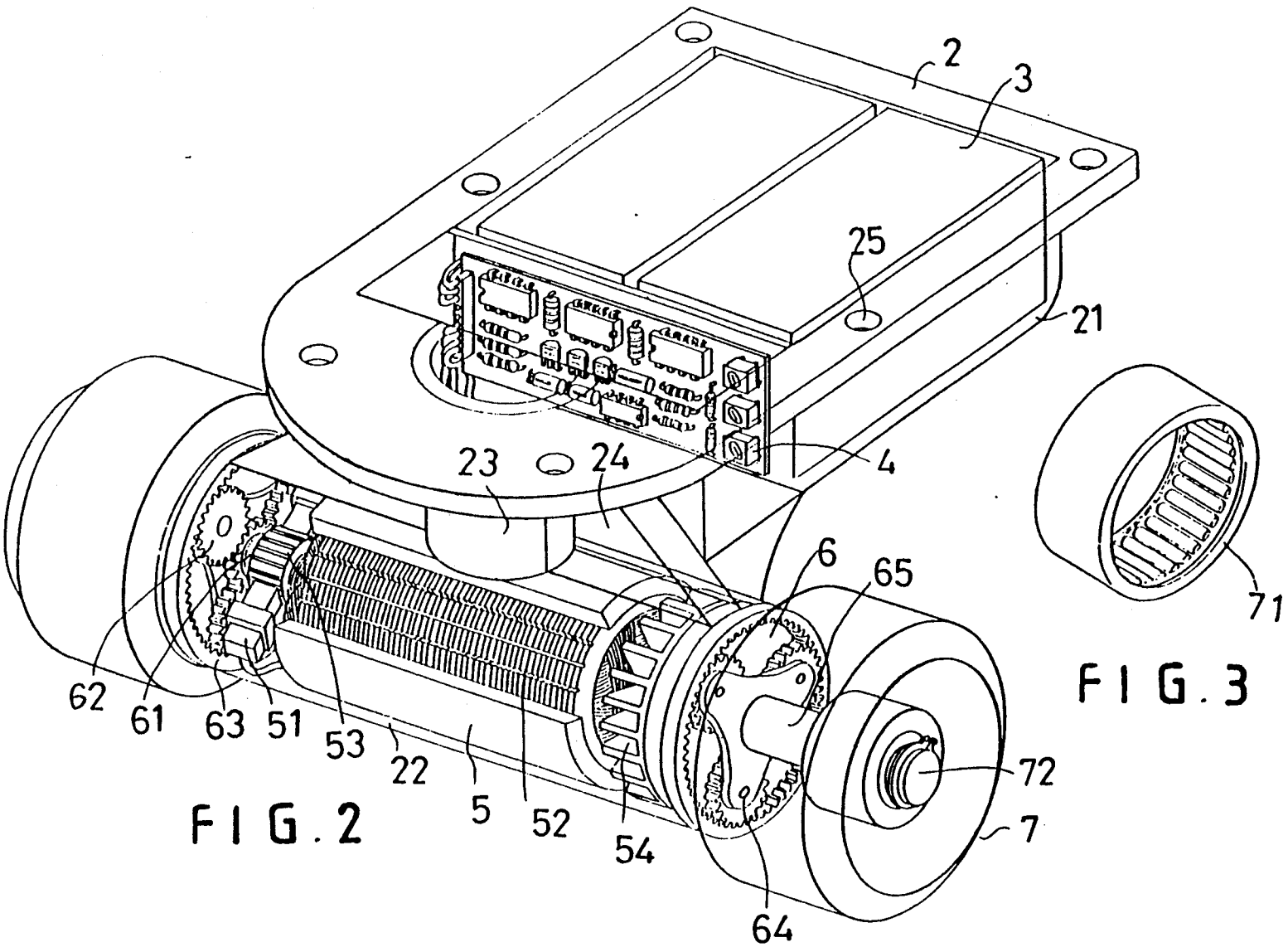
FIG. 2 is a partial perspective view of the structure of the remote-controlled electric skate-board in the present invention.
FIG. 3 is a perspective view of a one-way bearing in the remote-controlled electric skate-board in the present invention; and, FIG. 4 is a perspective view of the remotecontrolled electric skate-board of the present invention.

A remote-controlled electric skate-board in the present invention, as shown in FIGS. 1 and 2, includes a skate-board 1, a connecting base 2, a battery unit 3, a circuit board 4, a direct current motor 5, two sets of sun and planet gear units 6, 6, and two pairs of two rollers 7, 12 and a remote controller 8 as main components.

The skate-board 1 is made of a generally rectangular board 11 and has a pair of rollers 12 fixed on a rear portion.

The connecting base 2 is shaped as rectangular, having a rectangular upper plate and a chamber 21 under the upper plate for depositing therein the battery unit 3 and the circuit board 4 for arranging an electronic circuit for receiving signals from a remote controller 8 to start or stop the motor 5, a cylindrical housing 22 for containing the motor 5, a support post 23 between the cylindrical housing 22 and the rectangular plate, two reinforcing ribs 24, 24 at both sides of the support post 23 and a plurality of screw holes 25 around a circumferential edge of the upper plate for screws fix the connecting base 2 under a front bottom wall of the skate-board 1.

The battery unit 3 has several rechargable batteries to supply power to the circuit board 4 and the motor 5, contained in the chamber 21 of the connecting base 2. The electronic circuit arranged on the circuit board 4 is a well-known art for receiving wireless signals from the remote controller 8 for controlling the 15 operation of the motor 5, not described here.

The direct current motor 5 is deposited in the cylindrical housing 22 of the base 2 to drive the pair of two rollers 7, 7, having brushes 51 to connect with the circuit on the circuit board 4, a rotor 52 with a shaft 53, and a blowing fan 54 at one end. The shaft 53 of the rotor 52 has both its ends connected with a shaft of a sun gear 61 of each set of the two sun and planet gear units 6.

The sun and planet gear unit 6 consists of a sun gear 61, three planet gears 62 and an epicyclic gear 63 engaging one another. The sun gear 61 has its shaft combined with the shaft 53 of the motor 5 to rotate together, and the three planet gears 62 are sustained pivotally with a triangular bracket 64 firmly affixed with a shaft rod 65 at its center. And the epicyclic gear 63 is fixed stationary for the three planet gears 63 to rotate around the sun gear 61 and also around in the epicyclic gear 63.

The two sets of the sun and planet gear units 6, 6 are respectively provided at both ends of the cylindrical housing 22 of the connecting base 2 so as to combine with and move each roller 7.

The two rollers 7, 7 are respectively combined with a one-way bearing 71 in its inner wall and the bearing 71 is combined with a shaft 72 connected with the shaft rod 65 of the sun and planet gear unit 6 so that the rollers 7, 7 are rotated only in one direction by the bearing 71.

The remote controller 8 is used to transmit a wireless signal to the electronic circuit on the circuit board 4 for starting and stopping the motor 5, and being a well known art, is not to be described here.

In assembling, first, the battery unit 3 and the circuit board 4 are deposited in the chamber 21 of the base 2, and then the circuit board 4 is electrically connected with the motor 5 contained in the cylindrical housing 22 through the support post 23. Next, the two sets of the sun and planet gear units 6, 6 are respectively fixed at both the ends of the cylindrical housing 22. The epicyclic gear 63 is fixed stationary and the shaft of the sun gear 61 is connected with the shaft 53 of the motor 5, the planet gears 63 are pivotally combined with the bracket 64 affixed with the shaft rod 65. Then, the two rollers 7, 7 are combined with the shaft 72 which is connected with the shaft rod 65. Lastly the base 2, the motor 5 and the rollers 7, 7 together are combined with the front portion of the board 11 with screws.

Figure 4:
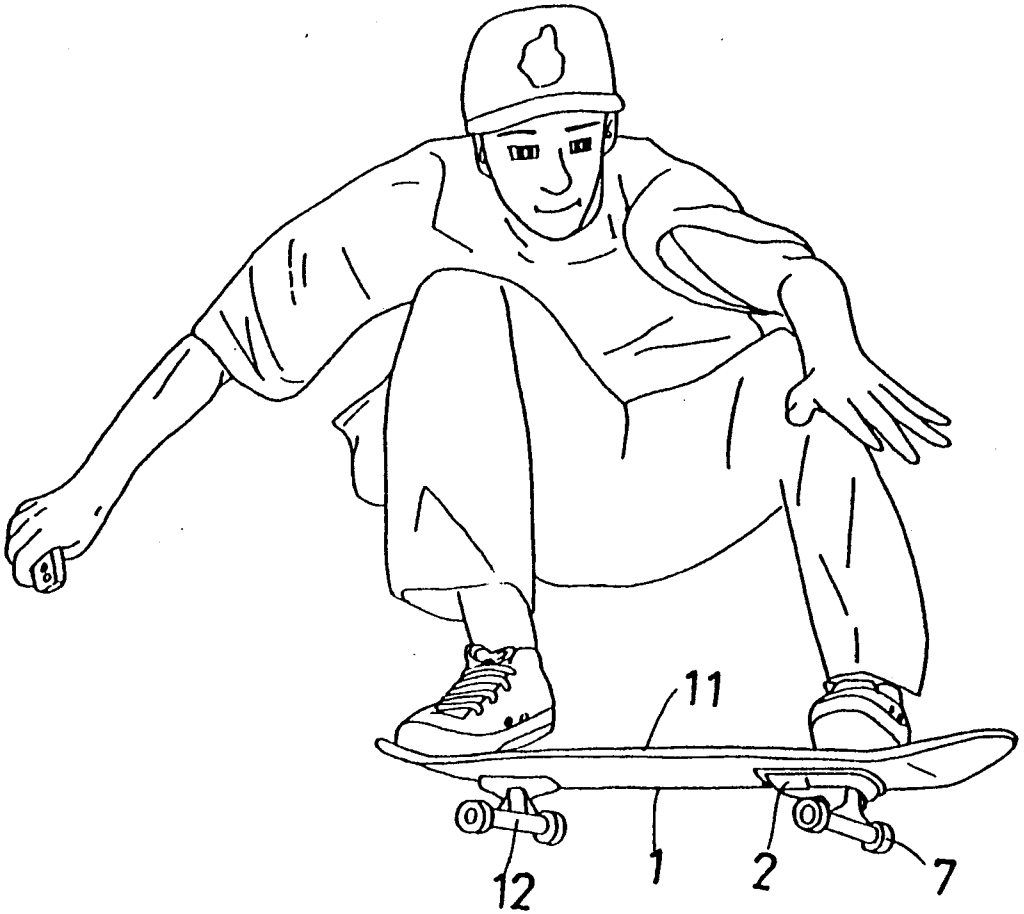

The rollers 7, 7 are rotated by the three planet gears 62, which is rotated by the sun gear 61 driven by the motor 5, being reduced in rotating speed by mutual gear teeth ratio and increasing their torque enough to move the skate-board with a person standing thereon. The remote controller 8 can operate the skate-board in addition to user's operation if desired, as shown in FIG. 4.

When this remote-controlled electric skate-board is used without the remote controller 8, it can be used as a common skate-board operated by human force. In case of moving on a smooth flat surface or on a slope, it can move more readily with the electric power to rotate the rollers 7, 7. A parent can also operate the remote controller 8 to assist a child while using the skate-board, increasing mutual interest in recreational activity.

While the preferred embodiments of the invention have been described above, it will be recognized and understood that various modifications may be made therein and the appended claims are intended to cover all such modifications which may fall within the spirit and scope of the invention.

What is claimed is:

1. A remote-controlled electric skate-board comprising:

a board of an elongate rectangular shape for a player to stand thereon;

a connecting base having a rectangular upper plate with a plurality of screw holes around a circumferential edge for screws to fix said connecting base with a front bottom wall of said board, a chamber under an upper plate for depositing a battery unit and a circuit board therein, a hollow cylindrical housing connected with a support post below said upper plate for placing a direct current motor, and two reinforcing ribs at both sides of said post;

said battery unit having several rechargable batteries to supply power to a circuit on said circuit board and said motor;

said circuit board for arranging the electronic circuit thereon for receiving signals from a remote controller and operating said motor;

said direct current motor deposited in said cylindrical housing of said connecting base, having both ends of a shaft respectively connected with and driving a shaft of a sun gear of each of a set of two sun and planet gear units and a blowing fan connected at one end;

the two sets of sun and planet gear units respectively having a sun gear with a shaft rod connected with said shaft of said direct current motor to be driven by said motor and three planet gears and a stationary epicyclic gear to engage one another to allow said three planet gears to rotate all simultaneously, said three planet gears sustained by a triangular bracket affixed with a shaft rod to rotate a roller fixed with said shaft rod;

a pair of rollers fixed under a front bottom portion of said board, respectively combined with a one-way bearing and then with a shaft connected with said shaft rod of each said sun and planet gear unit, rotated by said shaft rod to roll on the ground, and another pair of rollers fixed under a rear bottom portion of said board to roll by means of human force;

said remote controller to transmit wireless signals to the electronic circuit on said circuit board in said connecting base; and, said electronic circuit receiving a signal from said remote controller for starting or stopping said motor to rotate said two sets of said sun and planet gear units, said rollers under said front bottom portion of said board being rotated to move said skate-board in addition to human force.

* * * * *